US011988480B2

(12) United States Patent
Tusting et al.

(10) Patent No.: US 11,988,480 B2
(45) Date of Patent: May 21, 2024

(54) LEVER ACTION FIREARM

(71) Applicant: Bond Arms Inc., Granbury, TX (US)

(72) Inventors: Paul Alexander Tusting, Salt Lake City, UT (US); Jesse Daniel Carr, Fremont, NH (US)

(73) Assignee: Bond Arms Inc., Granbury, TX (US)

( * ) Notice: Subject to any disclaimer, the term of this patent is extended or adjusted under 35 U.S.C. 154(b) by 0 days.

(21) Appl. No.: 18/099,466

(22) Filed: Jan. 20, 2023

(65) Prior Publication Data

US 2023/0304755 A1 Sep. 28, 2023

Related U.S. Application Data

(60) Provisional application No. 63/304,139, filed on Jan. 28, 2022.

(51) Int. Cl.
*F41C 7/06* (2006.01)
*F41A 3/72* (2006.01)

(52) U.S. Cl.
CPC . *F41A 3/72* (2013.01); *F41C 7/06* (2013.01)

(58) Field of Classification Search
CPC ..... F41C 17/06
USPC ..... 42/18
See application file for complete search history.

(56) References Cited

U.S. PATENT DOCUMENTS 2,484,694 A 10/1949 Dicke
2,765,559 A * 10/1956 Morris ..... F41A 15/08 42/23
2,777,234 A 1/1957 Neal
2,881,547 A * 4/1959 Butler ..... F41A 3/18 42/16
9,328,990 B2 * 5/2016 Giannelli ..... F41C 7/06
(Continued)

FOREIGN PATENT DOCUMENTS

EP 3203178 A1 8/2017

OTHER PUBLICATIONS

Hrachya H, "Modern Lever-Action PCC by British Southern Gun Company," The Firearm Blog, https://www.thefirarmblog.com/blog/2021/09/21/brithish-southern-gun-company-9mm-lever-action-pcc/, Sep. 21, 2021, accessed Oct. 25, 2022.
(Continued)

*Primary Examiner* — Reginald S Tillman, Jr.
(74) *Attorney, Agent, or Firm* — Bennet K. Langlotz; Langlotz Patent & Trademark Works, LLC

(57) ABSTRACT

Lever action firearms have an upper frame defining a bolt passage, a bolt carrier assembly received in the upper frame and operable to reciprocate between an open position and a closed position, a lower frame defining a magazine well configured to removably receive a box magazine, the lower frame removably connected to the upper frame by a transverse takedown pin, an action lever movable between a retracted position and an extended position and having a first pivot, and pivotally connected to the lower frame at the first pivot, a first link pivotally connected to the lower frame, a second link pivotally connected to the bolt carrier assembly, the first link and second link pivotally interconnected to each other, the first link defining a cam path, and a cam follower on the action lever operably engaged to the cam path such that movement of the action lever generates movement of the bolt carrier assembly.

18 Claims, 16 Drawing Sheets

(56) References Cited

U.S. PATENT DOCUMENTS

2017/0227318 A1* 8/2017 Yaka ..... F41A 3/12

OTHER PUBLICATIONS

Brickwurx Mfg., "BrickWurX Mfg. Lever Action AR-15, Initial Cycle Test (Red Ryd-AR / Christmas-15)," YouTube, https://www.youtube.com/watch?v=SbXWqatpito, Aug. 16, 2019, Accessed Oct. 25, 2022.

www.gunpartscorp.com, "Winchester Model 88 Lever Action Rifle," URL and date of publication unknown.

Olin Mathieson Chemical Corporation, "Sequence of Take-Down and Assembly Operations Winchester Model 88 Lever Action Center Fire Rifle," Products Service Department, Winchester-Western Division, Various dates in 1956-1957.

American Rifleman Staff, "New For 2023: POF-USA Tombstone," American Rifleman, https://www.americanrifleman.org/content/new-for-2023-pof-usa-tombstone, Jan. 5, 2023, Accessed Jan. 9, 2023.

Duncan Johnson, "FightLite Launches Multi-Caliber Herring Model 2024 Lever Action," Ammoland Shooting Sports News, https://www.ammoland.com/2022/10/fightlite-launches-multi-caliber-herring-model-2024-lever-action, Oct. 29, 2022, Accessed Jan. 9, 2023.

* cited by examiner

LEVER ACTION FIREARM

CROSS-REFERENCE TO RELATED APPLICATION

This application claims the benefit of U.S. Provisional Patent Application No. 63/304,139 filed on Jan. 28, 2022, entitled "MODULAR LEVER ACTION FIREARM," which is hereby incorporated by reference in its entirety for all that is taught and disclosed therein.

FIELD OF THE INVENTION

The present invention relates to firearms, and more particularly to a lever action firearm that shares select component compatibility with existing firearm platforms, including the AR-15, to create a modern lever action firearm.

BACKGROUND AND SUMMARY OF THE INVENTION

The Winchester 1873 lever action rifle might have "won the west," but its toggle mechanism and tubular magazine had limitations as far as strength, power, capacity, and precision. In the 1880's, John M. Browning invented a family of lever action rifles with rear locking blocks capable of taming cartridges utilizing the new smokeless powders. Soon after, he figured out how to shrink this action while still chambering a rifle length cartridge, and the iconic Winchester 1894 was born. His final lever action rifle, the Winchester 1895, combined these innovations with an internal box magazine, allowing use of pointed "Spitzer" bullets, maximizing the potential of smokeless powders. Despite these innovations, all of these firearms were limited in their precision potential, capacity, and by the materials of the day.

The AR-15 is an extremely popular semi-automatic firearm that is designed to be extremely easy to use and easily customizable because of its modular design. Originally developed in the 1950s, many companies now manufacture versions of the firearm and accessories for it utilizing modern materials and cartridges. However, many jurisdictions restrict the ownership and use of semi-automatic AR-15 firearms.

Therefore, a need exists for a new and improved lever action firearm that shares select component compatibility with existing firearm platforms, including the AR-15, to create a modern lever action firearm. In this regard, the various embodiments of the present invention substantially fulfill at least some of these needs. In this respect, the lever action firearm according to the present invention substantially departs from the conventional concepts and designs of the prior art, and in doing so provides an apparatus primarily developed for the purpose of sharing select component compatibility with existing firearm platforms, including the AR-15, to create a modern lever action firearm.

The present invention provides an improved lever action firearm, and overcomes the above-mentioned disadvantages and drawbacks of the prior art. As such, the general purpose of the present invention, which will be described subsequently in greater detail, is to provide an improved lever action firearm that has all the advantages of the prior art mentioned above.

To attain this, the preferred embodiment of the present invention essentially comprises an upper frame defining a bolt passage, a bolt carrier assembly received in the upper frame and operable to reciprocate between an open position and a closed position, a lower frame defining a magazine well configured to removably receive a box magazine, the lower frame removably connected to the upper frame by way of a transverse takedown pin, an action lever movable between a retracted position and an extended position and having a first pivot, and pivotally connected to the lower frame at the first pivot, a first link pivotally connected to the lower frame, a second link pivotally connected to the bolt carrier assembly, the first link and second link pivotally interconnected to each other, the first link defining a cam path, and a cam follower on the action lever operably engaged to the cam path such that movement of the action lever between the retracted position and the extended position generates movement of the bolt carrier assembly between the closed position and the open position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
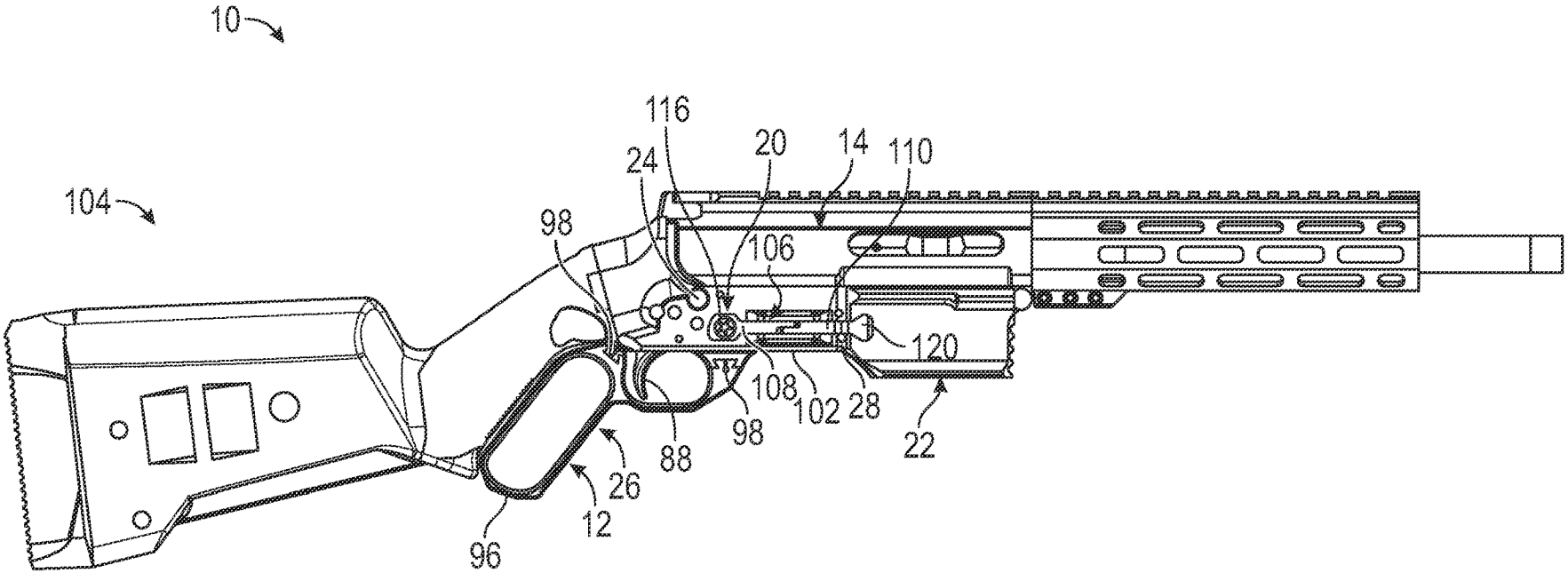
FIG. 1 is a right side view of the current embodiment of a lever action firearm constructed in accordance with the principles of the present invention.

An embodiment of the lever action firearm of the present invention is shown and generally designated by the reference numeral 10.

Figure 2:
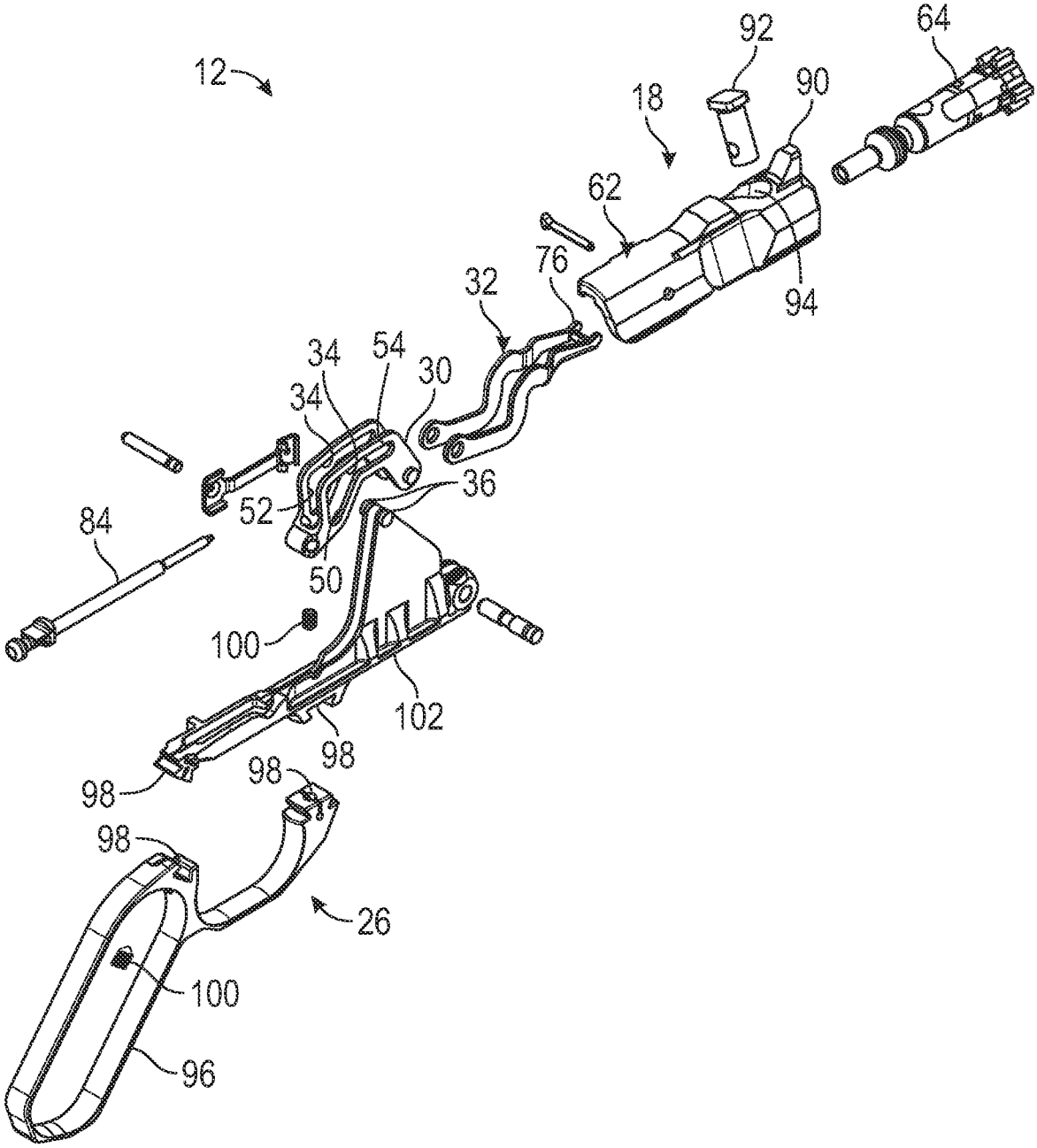
FIG. 2 is an exploded view of the bolt carrier motion subassembly of the lever action firearm of FIG. 1.
Figure 3:
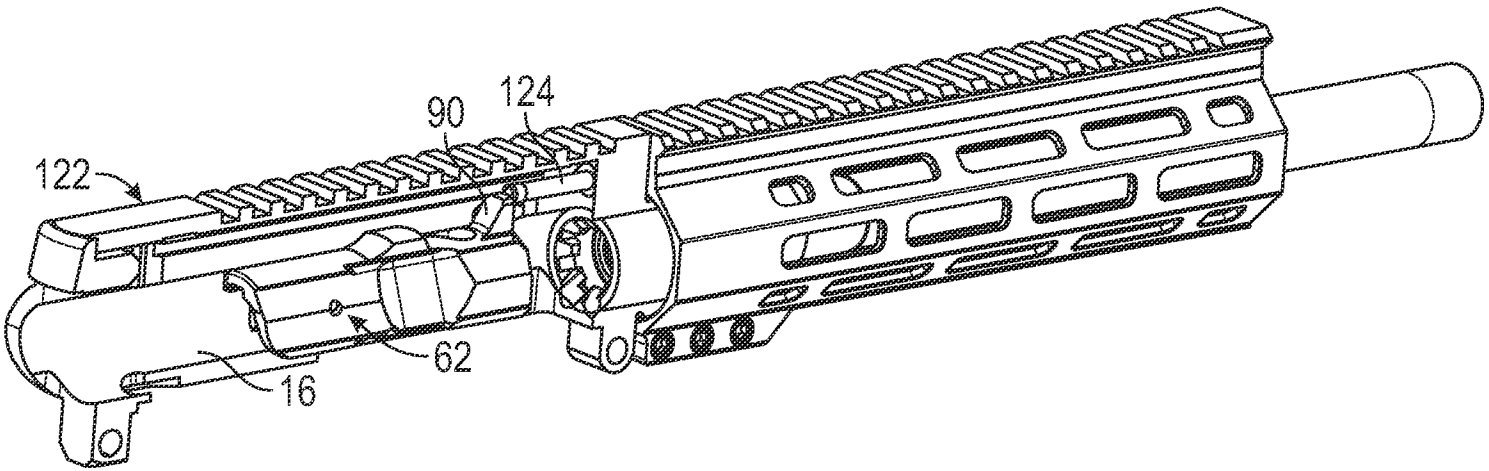
FIG. 3 is a partially sectional isometric view of the upper frame assembly of the lever action firearm of FIG. 1 showing how the bolt carrier cannot be used in the upper frame of a firearm having a gas tube present.

FIG. 1 illustrates the improved lever action firearm 10 of the present invention. FIG. 2 illustrates the improved bolt carrier motion subassembly 12. More particularly, the lever action firearm has an upper frame 14 defining a bolt passage 16 (shown in FIGS. 6A-G). A bolt carrier assembly 18, including a bolt carrier 62 and a bolt subassembly 64, is received in the upper frame and is operable to reciprocate between an open position and a closed position. FIG. 3 illustrates how a forward protrusion 90 on the bolt carrier prevents the bolt carrier assembly from being installed in the bolt passage 16 of a conventional AR-15 upper frame 122 having a gas tube 124 installed by providing an obstruction. Because gas is not used to cycle the bolt carrier assembly of the current invention, having a gas tube present is highly undesirable because gas entering the bolt passage would blow past the bolt carrier assembly into the user's face. Other approaches to prevent gas from entering the bolt passage include a gas key on top of the bolt carrier that has a blind hole to receive the gas tube and a low-profile upper frame that eliminates the gas tube and its associated passage.

A lower frame 20 defines a magazine well 22 (shown in FIGS. 6A-G) configured to removably receive a box magazine (not shown). The lower frame is removably connected to the upper frame by way of a transverse takedown pin 24. An action lever 26 is movable between a retracted position (shown in FIGS. 6A & G) and an extended position (shown in FIG. 6C) and has a first pivot 28. The action lever is pivotally connected to the lower frame at the first pivot. A rear portion 96 of the action lever is removably connected by dovetail joints 98 and set screws 100 to a forward portion 102 that includes a cam follower 36. This feature enables a wide variety of stocks 104 to be used because the rear portion of the action lever can be changed to closely fit a selected stock.

A first link 30 is pivotally connected to the lower frame 20. A second link 32 is pivotally connected to the bolt carrier assembly 18. In the current embodiment, the first link and second link are pivotally interconnected to each other. The first link defines a cam path 34. The cam follower 36 on the action lever 26 is operably engaged to the cam path such that movement of the action lever between the retracted position and the extended position generates movement of the bolt carrier assembly between the closed position and the open position. It should be appreciated that the second link has a bend that creates a concave downward position front segment and middle segment angled together, which serves to clear internal elements in the upper frame 14. The second link includes three segments joined by approximately right angled articulations. The forwardmost and rearmost segments are approximately parallel, and the middle segment connecting them is approximately perpendicular to them. Thus, the second link is an articulated member having at least two articulations, each articulated in an opposite direction forming a zig-zag shape. The forward articulation clears a forward portion of the lower frame when the bolt carrier assembly is closed. The forwardmost segment is internal to the bolt passage 16 and aligned along the bolt carrier assembly when the bolt carrier assembly is closed.

The upper frame 14 includes a rear lug 38 (shown in FIGS. 6A-G) received by a recess 40 (shown in FIGS. 6A-G) in the lower frame. The rear lug and lower frame define registered pin bores 42 (shown in FIGS. 6A-G), 44 (shown in FIG. 9) receiving the transverse takedown pin 24. The first and second links 30, 32 are forward of the rear lug. The phrase "forward of the rear lug" means forward of a transverse plane at the front of the rear lug, even if above or below the level of the lug. In the current embodiment, all of the pivot connections associated with the action lever 26, first and second links, and bolt carrier assembly 18 are forward of the rear lug.

In the current embodiment, the cam path 34 includes a first cam surface 46 configured for engagement by the cam follower 36 during movement of the action lever 26 from the retracted position to the extended position (shown in FIGS. 6A-C), and an opposed second cam surface 48 configured for engagement by the cam follower during movement of the action lever from the extended position to the retracted position (shown in FIGS. 6D-G). It should be appreciated that the first and second cam surfaces may define an elongated channel 50 of varying width. In the current embodiment, the elongated channel has a rear portion 52 that is wider than a forward portion 54, and at least one of the cam surfaces has at least three different straight segments each angularly offset from each other. In the current embodiment, the second cam surface has three different straight segments 56, 58, 60 each angularly offset from each other.

Figure 4:
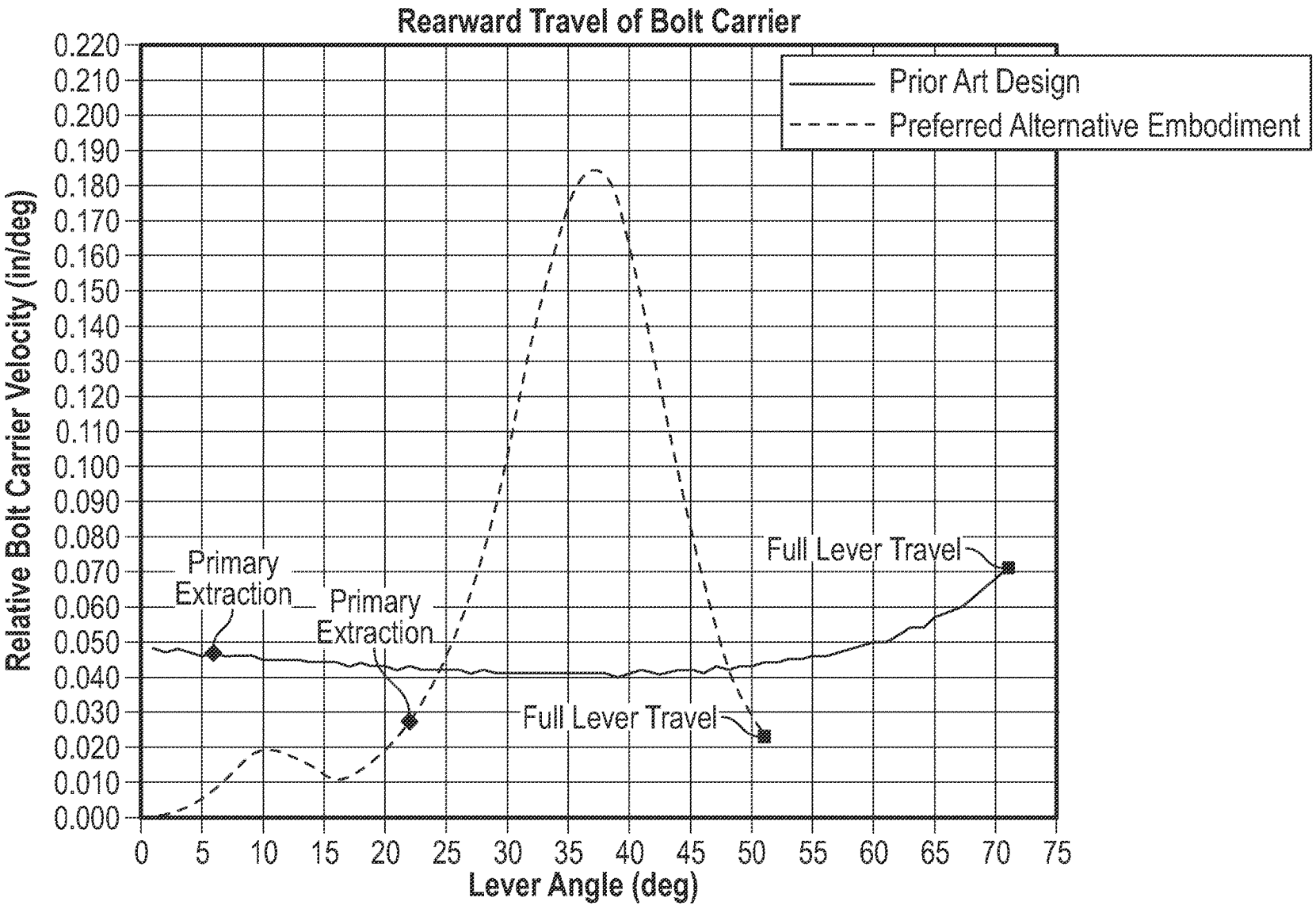
FIG. 4 is a graph of the relative bolt carrier velocity of the lever action firearm of FIG. 1 as the action lever is cycled to extract and eject a spent cartridge.
Figure 5:
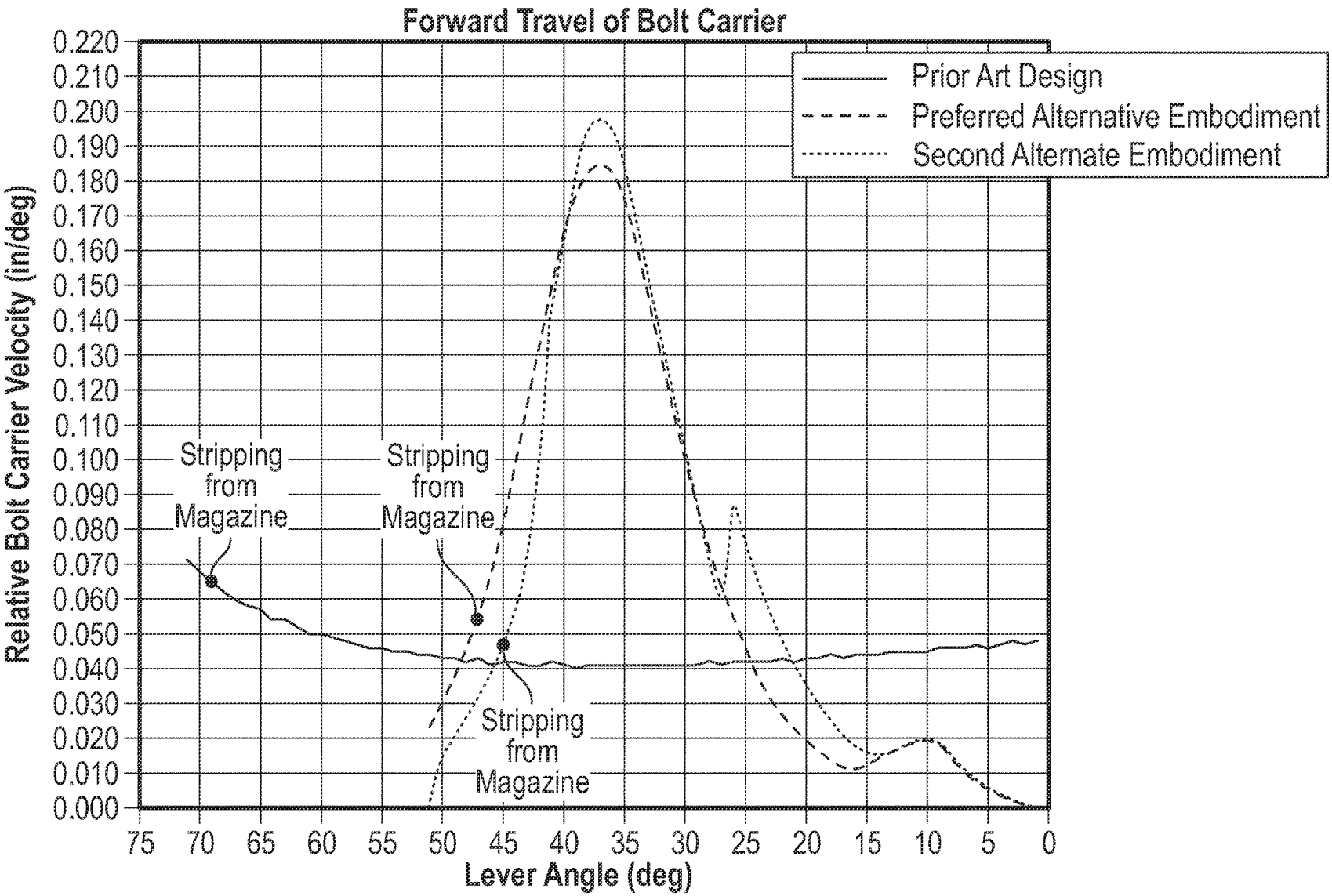
FIG. 5 is a graph of the relative bolt carrier velocity of the lever action firearm of FIG. 1 as the action lever is cycled to strip and chamber a new cartridge.
Figure 6A:
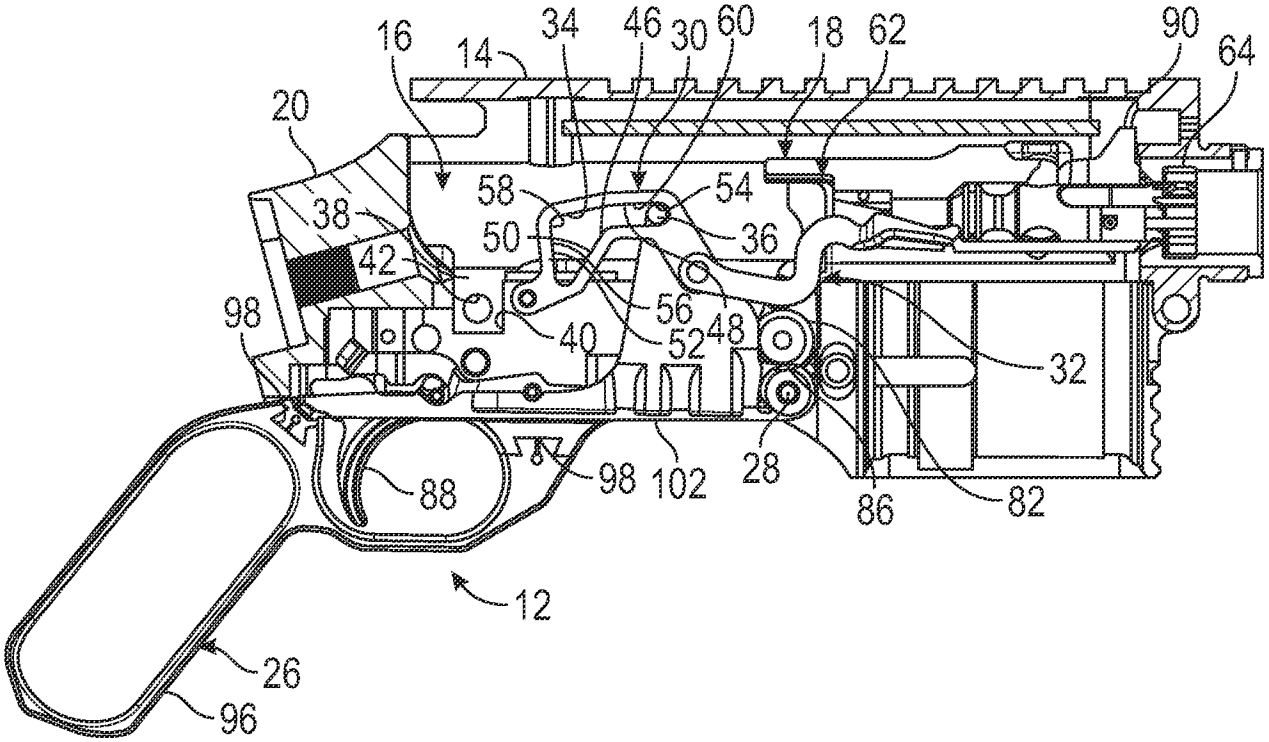
FIG. 6A is a side sectional view of the upper frame and bolt carrier motion subassembly of the lever action firearm of FIG. 1 in the in-battery, hammer down condition immediately after discharge.
Figure 6B:
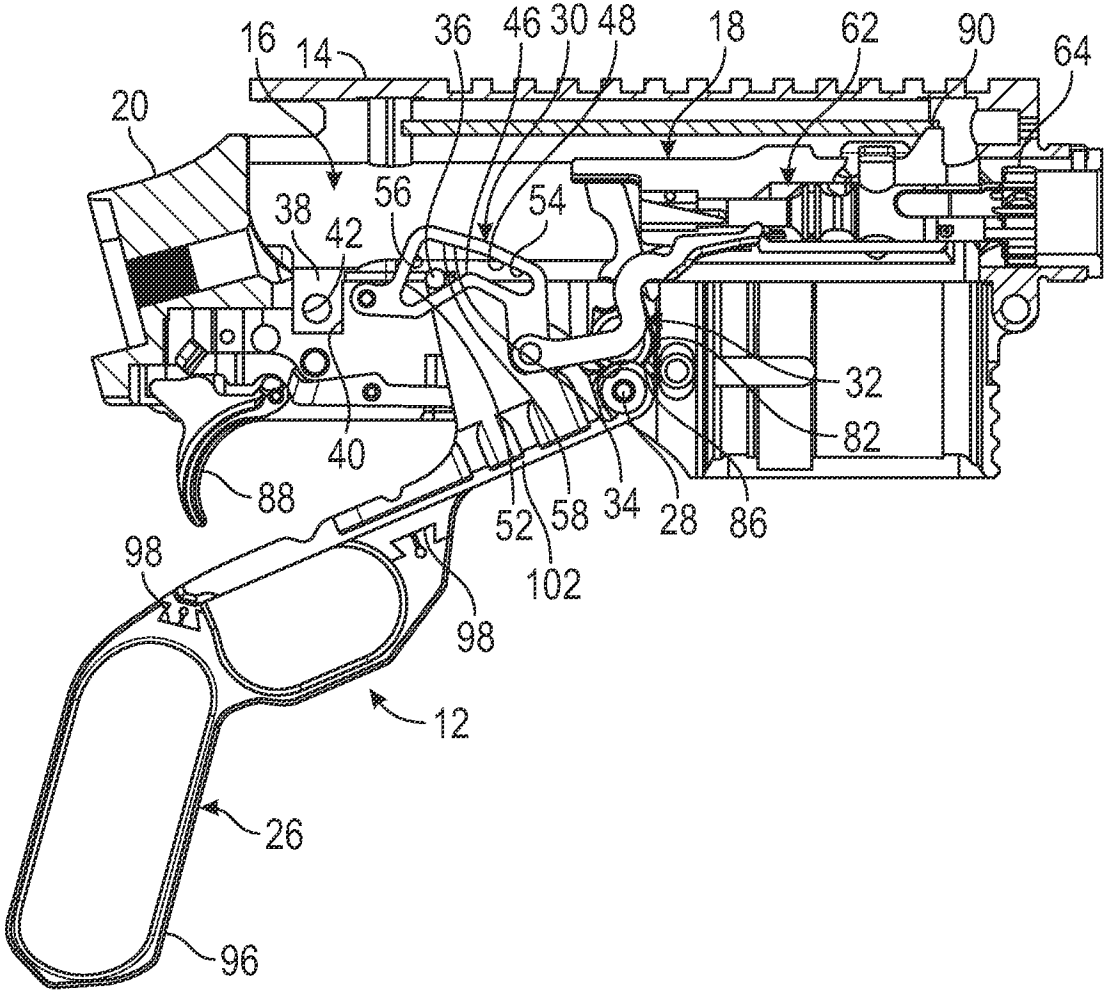
FIG. 6B is a side sectional view of the upper frame and bolt carrier motion subassembly of the lever action firearm of FIG. 1 in the bolt subassembly unlocked from the barrel extension condition.
Figure 6C:
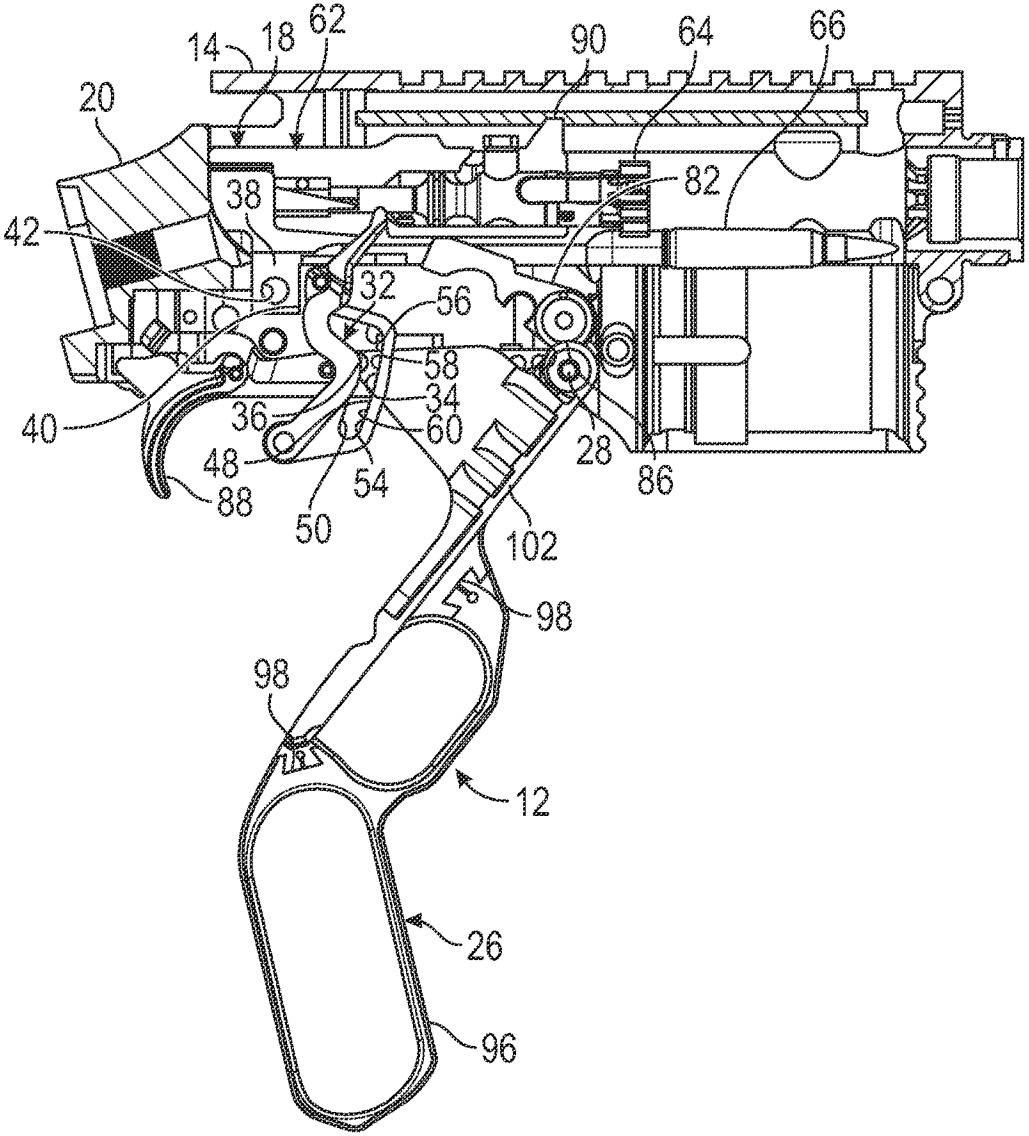
FIG. 6C is a side sectional view of the upper frame and bolt carrier motion subassembly of the lever action firearm of FIG. 1 in the rearmost travel condition.
Figure 6D:
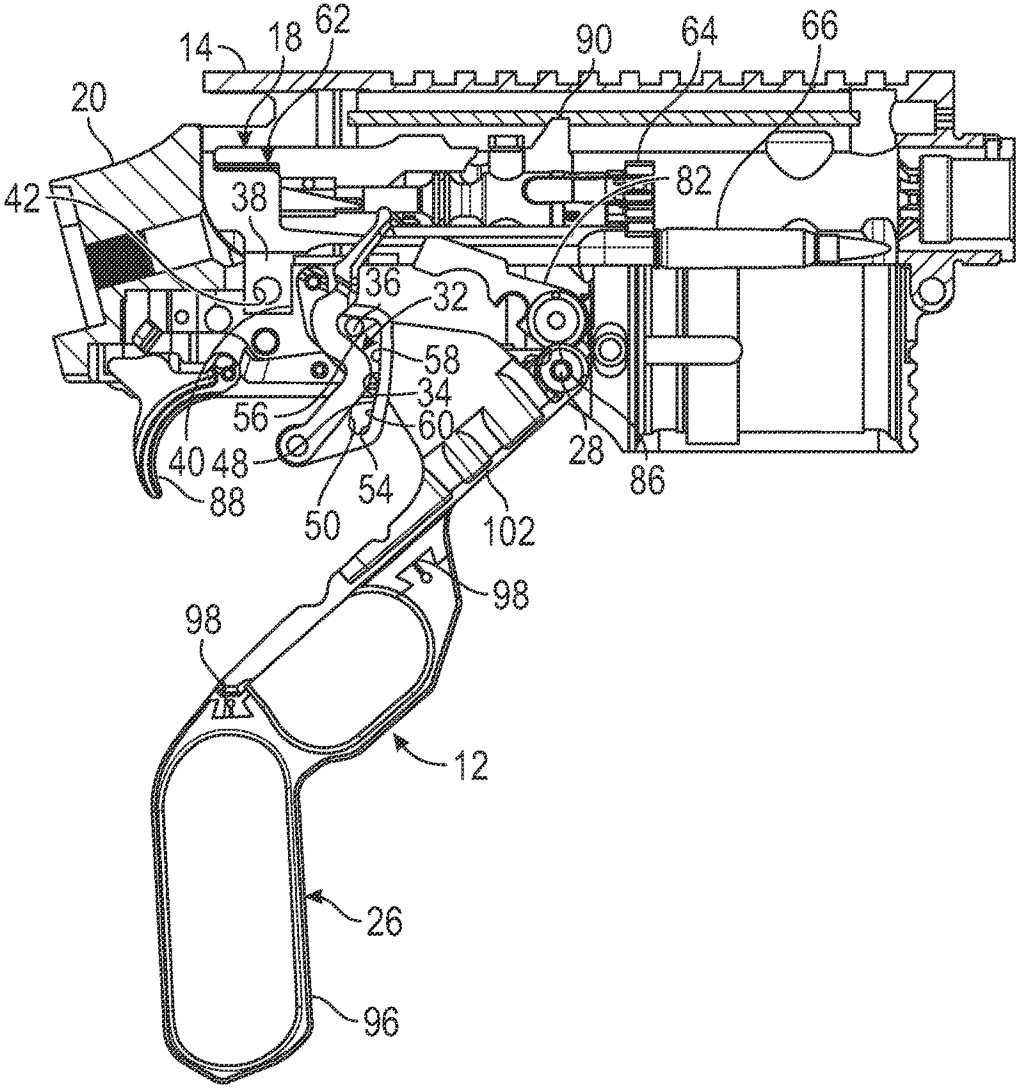
FIG. 6D is a side sectional view of the upper frame and bolt carrier motion subassembly of the lever action firearm of FIG. 1 in the stripping a new cartridge from the magazine condition.
Figure 6E:
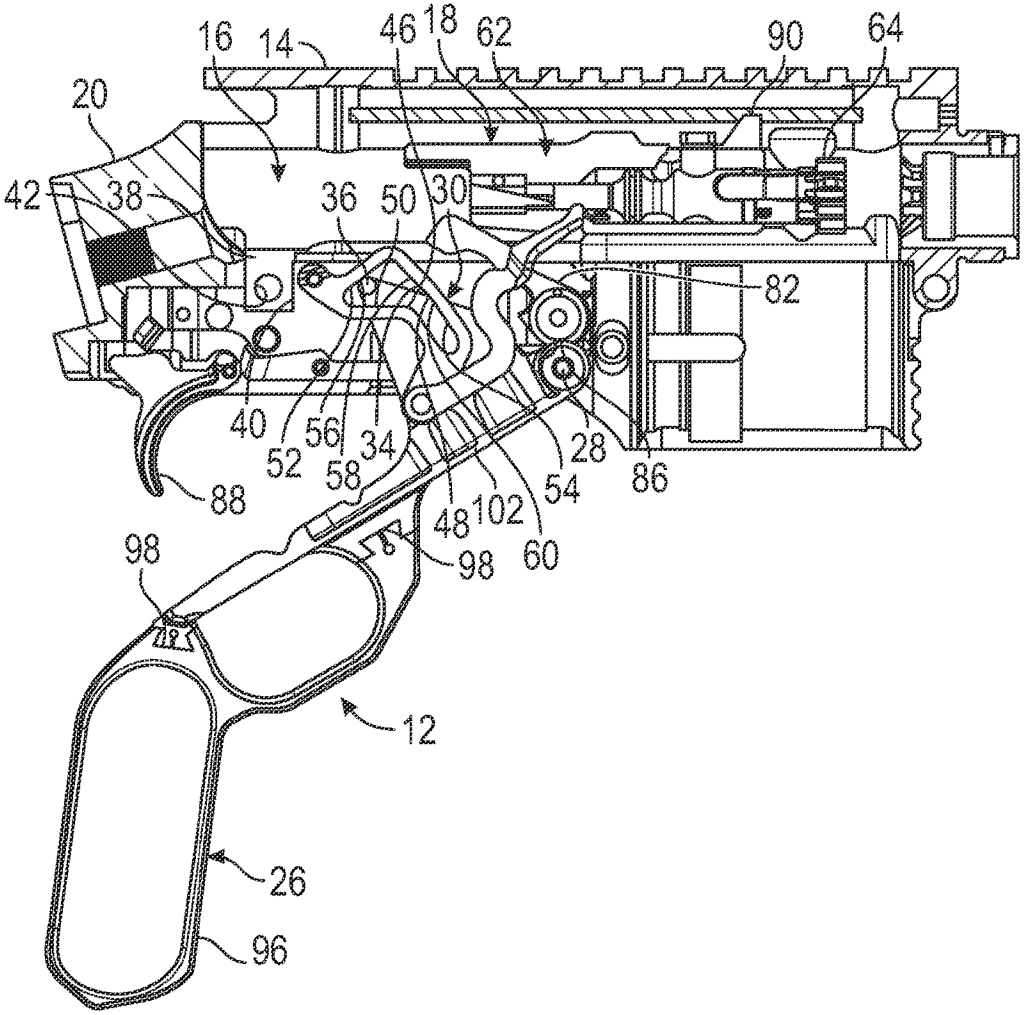
FIG. 6E is a side sectional view of the upper frame and bolt carrier motion subassembly of the lever action firearm of FIG. 1 in the sear engaged with the hammer condition.

FIG. 4 is a graph of the bolt carrier 62 relative velocity of the lever action firearm 10 as the action lever 26 is cycled to extract and eject a spent cartridge, and FIG. 5 is a graph of the bolt carrier 62 relative velocity of the lever action firearm as the action lever is cycled to strip and chamber a new cartridge 66 (shown in FIG. 6D). More particularly, the elongated channel 50 is configured to provide greater leverage for a given lever force when the action lever is in an initial phase of operation from the extended position to an intermediate position (FIGS. 6C-D) than from past the intermediate position towards the retracted position (FIG. 6E). The elongated channel is also configured to provide greater leverage when the bolt carrier assembly 18 is initially stripping a cartridge from the magazine (FIG. 6D) then when the cartridge is being chambered (FIG. 6E).

In FIG. 4, the two lines in the chart are a reference prior art design and the current invention employing any of the embodiments of the first link 130, 230, 30 (shown in FIGS. 10A-C) because all of them have the same bottom surfaces of the cam tracks 134, 234, 34 that control rearward travel of the bolt carrier 62. The axes show the angle of the lever in degrees on the x-axis and the relative velocity of the bolt carrier as a function of lever angle in inches/degree on the y-axis. The chart shows two critical times during the rearward travel of the bolt carrier: 1) primary extraction (when an empty cartridge case is first broken free from the chamber in the barrel), marked with diamonds, with a low value on the y-axis being desirable as it indicates a lot of leverage, and 2) the full travel of the lever, marked with squares, with a low value on the x-axis being desirable as it indicates you need less hand movement to operate the firearm. Usually the two values are competing, but because of the current invention's non-linear motion, good values of both are achieved.

Figure 10A:
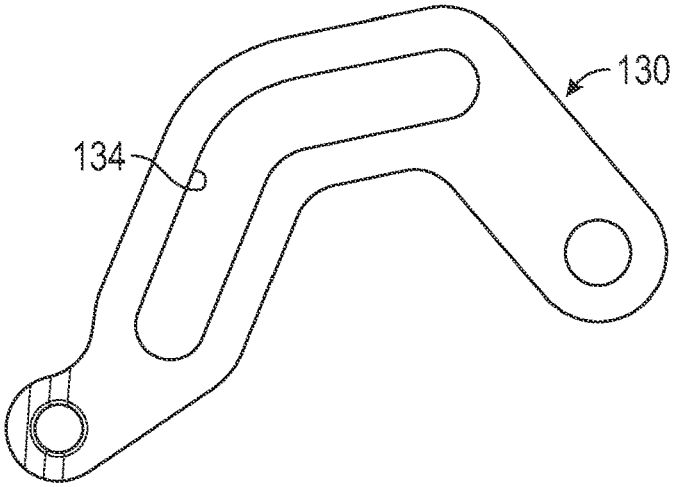
FIG. 10A is a right side view of a preferred alternative embodiment of the first link of FIG. 2.
Figure 10B:
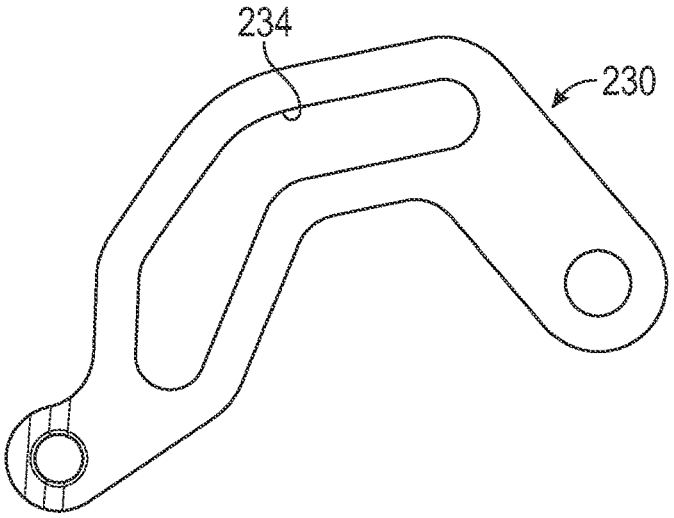
FIG. 10B is a right side view of a second alternative embodiment of the first link of FIG. 2.

In FIG. 5, the three lines in the chart are a reference prior art design, the current invention employing the preferred alternative embodiment of the first link 130 (shown in FIG. 10A), and a second alternative embodiment of the first link 230 (shown in FIG. 10B). The axes show the angle of the lever in degrees on the x-axis and the relative velocity of the bolt carrier as a function of lever angle in inches/degree on the y-axis. This chart is essentially a mirrored version of FIG. 4, starting with the lever open. Being "mirrored" is especially true for the first link 130 because the top/bottom surfaces of the cam track 134 are parallel. The second alternative embodiment of the first link has a slight "hump," making the cam track non-symmetric and non-parallel.

FIG. 5 shows one critical moment during the forward travel of the bolt carrier 62: initial stripping of rounds out of the magazine. The standard capacity of an AR-15 is 30 rounds, which results in a lot of spring force between the uppermost round and the magazine lips. As a result, lots of leverage (as shown as a lower value on the y-axis) is desirable. The y-axis value of the preferred alternative embodiment of the first link 130 having a parallel cam track 134 is lower than the reference prior art design. The y-axis value of the second alternative embodiment 230 is even lower.

Figure 6F:
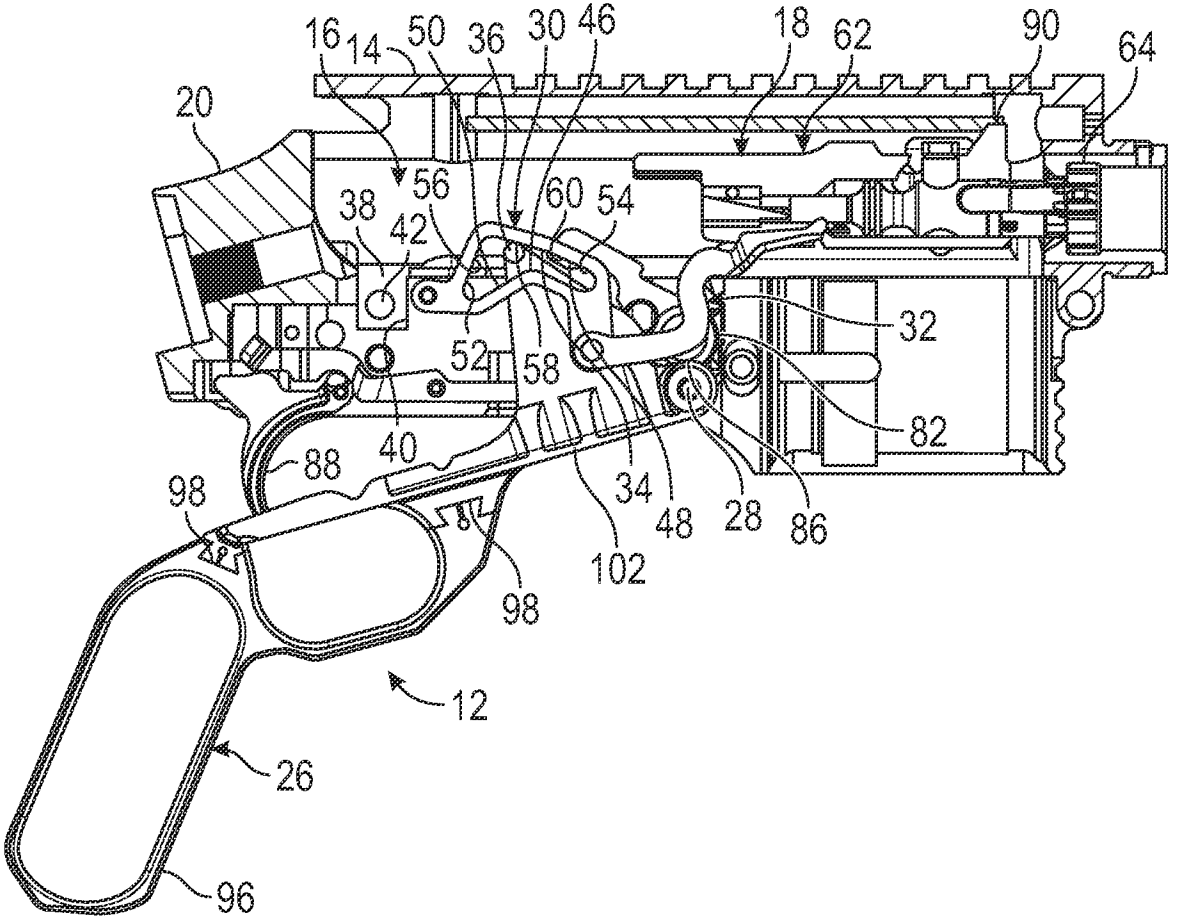
FIG. 6F is a side sectional view of the upper frame and bolt carrier motion subassembly of the lever action firearm of FIG. 1 in the bolt subassembly contacting the barrel condition.
Figure 6G:
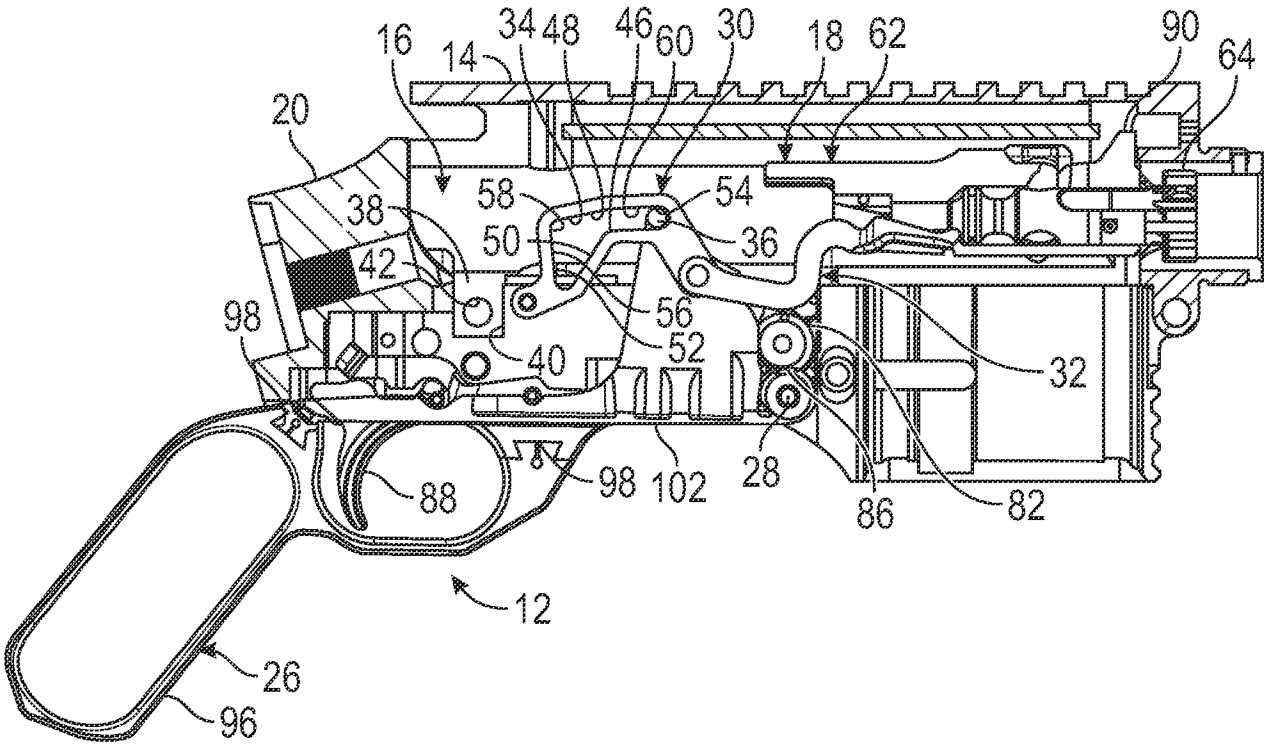
FIG. 6G is a side sectional view of the upper frame and bolt carrier motion subassembly of the lever action firearm of FIG. 1 in the in-battery, hammer cocked and ready to fire condition.

FIGS. 6A-G depict the steps in the cycle of fire of the lever action firearm 10. More particularly, FIG. 6A shows the bolt carrier motion subassembly 12 in the in-battery condition with the hammer 82 down having impacted the firing pin 84 to discharge the chambered cartridge 66. The action lever 26 is in the retracted position. FIG. 6B shows the action lever in the process of pivoting to the extended position. The bolt subassembly 64 has unlocked from the barrel extension under the influence of a bolt cam pin 92 in a cam slot 94, which will enable the bolt carrier assembly 18 to begin to move rearward. In the current embodiment, the second link is pivotally connected to the bolt carrier below the bolt subassembly and rearward of the cam slot 94. FIG. 6C shows the action lever in the extended position. The bolt carrier assembly has reached the rearmost travel position, which has pivoted the hammer rearward towards the cocked position. The spent cartridge has been extracted from the chamber and ejected from the upper frame 14. FIG. 6D shows the action lever in the process of returning to the retracted position. The bolt subassembly is stripping a new cartridge from a box magazine. FIG. 6E shows the action lever further in the process of returning to the retracted position. The hammer is releasably secured in the cocked position by the sear 86, which enables the bolt carrier assembly to continue to move forward with the hammer remaining restrained. FIG. 6F shows the action lever further in the process of returning to the retracted position. The bolt subassembly contacts the barrel, and the hammer remains restrained by the sear in the cocked position. FIG. 6G shows the action lever having returned to the retracted position. The bolt carrier assembly is in the in-battery condition, and the hammer remains restrained by the sear in the cocked position. The lever action firearm 10 is now ready to be fired when the trigger 88 is pulled, which will place the lever action firearm in the condition depicted in FIG. 6A. With some prior art lever action firearms, pulling the trigger will not release a hammer or striker unless the action lever is in the fully retracted position. Furthermore, the action lever may have a spring bias or detent to a slightly extended position, such that the user's active grip is required to fully retract the action lever, and render it ready to be fired.

Figure 7:
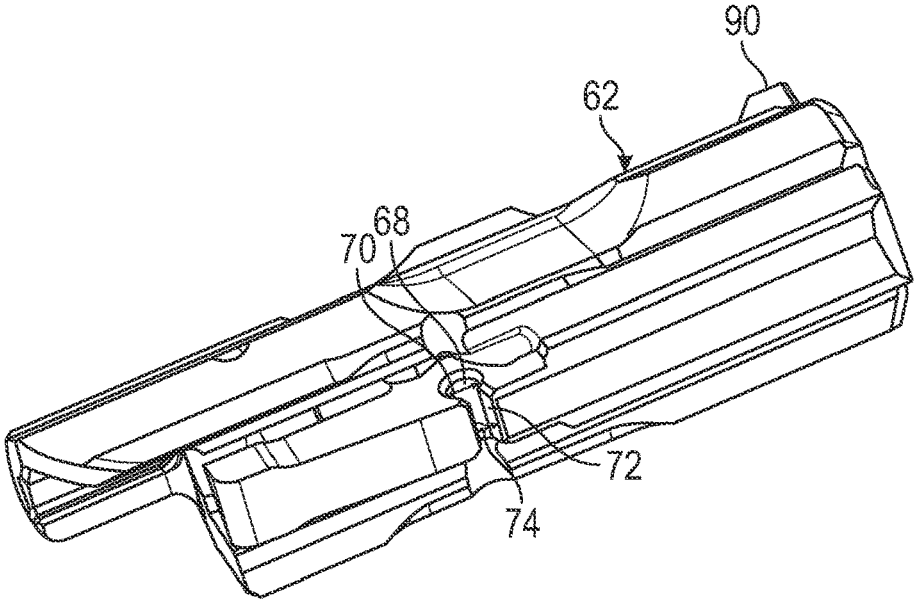
FIG. 7 is a bottom isometric view of the bolt carrier of the lever action firearm of FIG. 1.
Figure 8A:
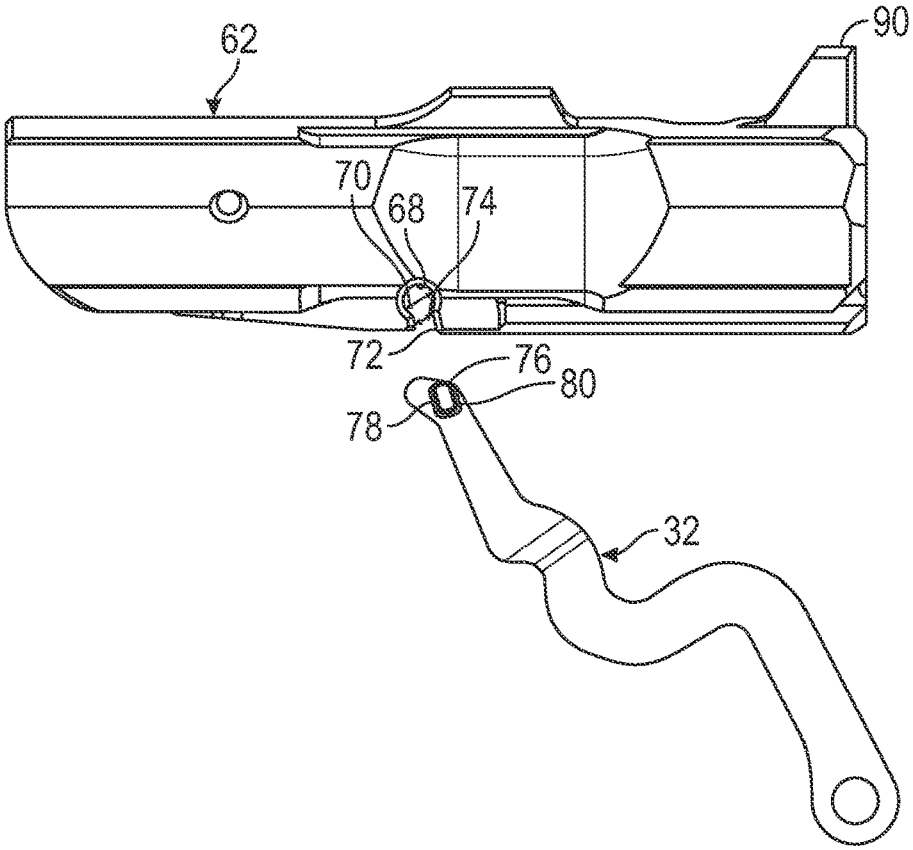
FIG. 8A is a right side sectional view of the second link and bolt carrier of the lever action firearm of FIG. 1 with the second link being aligned for connection to the bolt carrier.
Figure 8B:
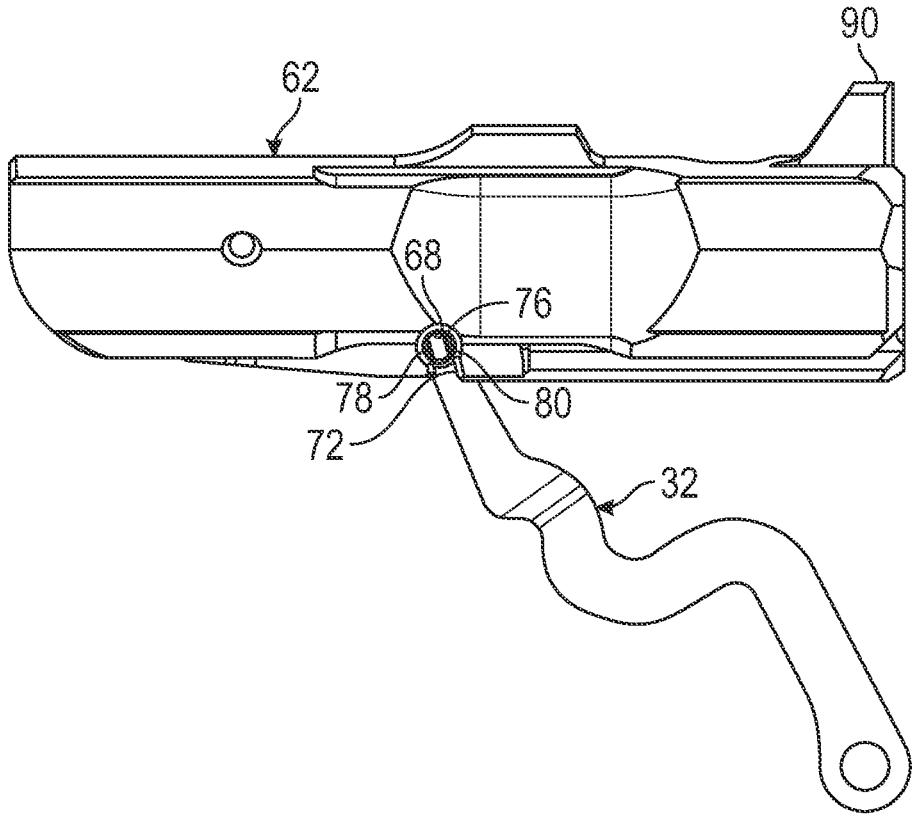
FIG. 8B is a right side sectional view of the second link and bolt carrier of the lever action firearm of FIG. 1 with the second link being inserted into the bolt carrier.
Figure 8C:
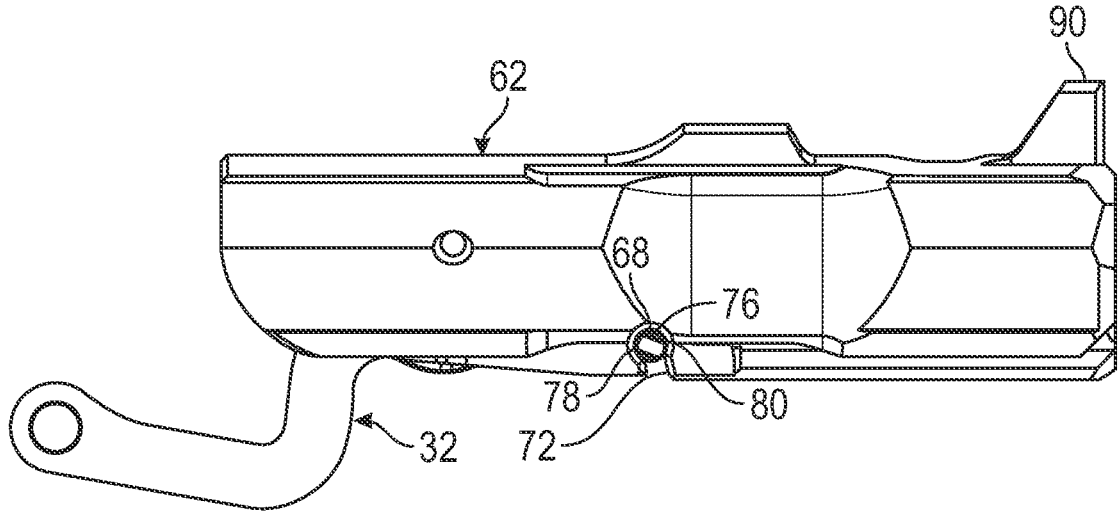
FIG. 8C is a right side sectional view of the second link and bolt carrier of the lever action firearm of FIG. 1 with the second link being rotated to lock into the bolt carrier, which is shown in the in-battery condition.

FIG. 7 illustrates the improved bolt carrier 62 of the present invention. FIGS. 8A-C illustrate the process of connecting the second link 32 to the bolt carrier. More particularly, the bolt carrier portion of the bolt carrier assembly 18 defines a transverse bore 68 having a bolt bore diameter 70 and laterally communicating externally to the bolt carrier assembly by way of a slot 72 having a width 74 less than the bolt bore diameter. The second link includes a transverse pin 76 closely received in the transverse bore and having a reduced thickness in one dimension less than the slot width such that the transverse pin is removable from the transverse bore by way of the slot when the second link is in a selected orientation with respect to the bolt carrier assembly (the orientation shown in FIG. 8B). In the current embodiment, the transverse pin has opposed flat surfaces 78, 80 running along its length. It should be appreciated that the second link is connected directly to the bolt carrier assembly without additional fasteners and that the connection between the second link and the bolt carrier assembly is free of separate fasteners. The second link can be configured as a single component as shown in FIG. 2, or as multiple components similar to the sectional views shown in FIGS. 8A-C.

Figure 9:
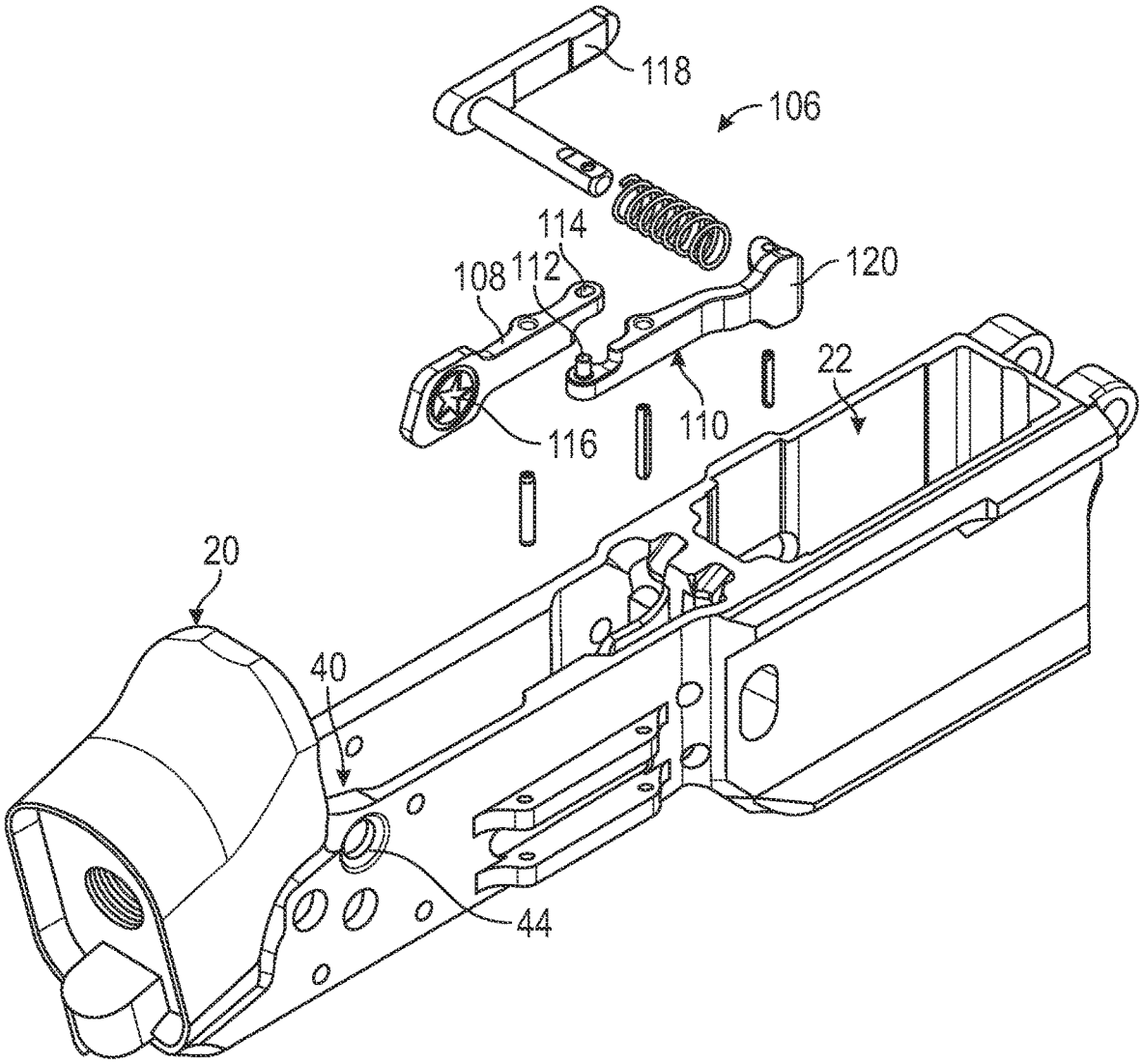
FIG. 9 is an exploded view of the magazine catch subassembly and lower frame of the lever action firearm of FIG. 1.

FIG. 9 illustrates the improved magazine catch subassembly 106 of the present invention. More particularly, the magazine catch subassembly includes two lever arms 108, 110 connected by a pin 112 received in an aperture 114. The lengths and pivots of the lever arms are proportioned so that a force applied at one end 116 remains a similar amount of force when it is transmitted to the magazine catch 118 by the other end 120. The magazine catch subassembly enables a user to activate the magazine catch to release the box magazine from the magazine well 22 from the different hand position used with the lever action firearm 10 relative to the hand position used with a conventional AR-15 firearm with a pistol grip.

Figure 10C:
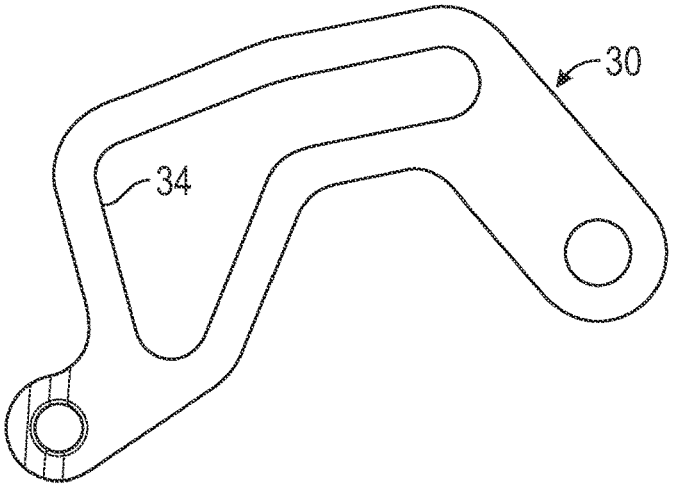
FIG. 10C is a right side view of the first link of FIG. 2.

FIG. 10A illustrates a preferred alternative embodiment of the first link 130. FIG. 10B illustrates a second alternative embodiment of the first link 230. FIG. 10C illustrates the first link 30. During the acquisition of data to create FIGS. 4 & 5, it was learned that the second alternative embodiment of the first link 230 performs the best of the three embodiments. However, it should be appreciated that all three embodiments of the first link perform significantly better than the reference prior art design as shown in FIGS. 4 & 5 in regard to primary extraction, full travel of the lever, and stripping from the magazine.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a lever action firearm has been described in detail, it should be apparent that modifications and variations thereto are possible, all of which fall within the true spirit and scope of the invention. Although select component compatibility with existing firearm platforms including the AR-15 action length has been disclosed, the lever action firearm can also share select component compatibility with the AR-10 action length, as well as smaller pistol and rimfire caliber versions of the AR family, along with related long action firearms such as the Omen series firearms manufactured by Nemo Arms, Inc. of Nampa, ID. The lever action firearm can also be a shotgun, or even a handgun. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A lever action firearm comprising:

an upper frame defining a bolt passage;

a bolt carrier assembly received in the upper frame and operable to reciprocate between an open position and a closed position;

a lower frame defining a magazine well configured to removably receive a box magazine;

the lower frame removably connected to the upper frame by way of a transverse takedown pin;

an action lever movable between a retracted position and an extended position and having a first pivot, and pivotally connected to the lower frame at the first pivot;

a first link pivotally connected to the lower frame;

a second link pivotally connected to the bolt carrier assembly;

the first link and second link pivotally interconnected to each other;

the first link defining a cam path; and a cam follower on the action lever operably engaged to the cam path such that movement of the action lever between the retracted position and the extended position generates movement of the bolt carrier assembly between the closed position and the open position.

2. The lever action firearm of claim 1 wherein the upper frame includes a rear lug received by a recess in the lower frame, the rear lug and lower frame defining registered pin bores receiving the transverse takedown pin, and wherein the first and second links are forward of the rear lug.

3. The lever action firearm of claim 2 wherein all of the pivot connections associated with the action lever, first and second links, and bolt carrier assembly are forward of the rear lug.

4. The lever action firearm of claim 1 wherein the cam path includes a first cam surface configured for engagement by the cam follower during movement of the action lever from the retracted position to the extended position, and an opposed second cam surface configured for engagement by the cam follower during movement of the action lever from the extended position to the retracted position.

5. The lever action firearm of claim 4 wherein the first and second cam surfaces define an elongated channel of varying width.

6. The lever action firearm of claim 5 wherein the elongated channel has a rear portion wider than a forward portion.

7. The lever action firearm of claim 4 wherein the elongated channel is configured to provide greater leverage for a given lever force when the action lever is in an initial phase of operation from the extended position to an intermediate position than from the intermediate position to the retracted position.

8. The lever action firearm of claim 4 wherein the elongated channel is configured to provide greater leverage when the bolt carrier assembly is initially stripping a cartridge from the magazine then when the cartridge is being chambered.

9. The lever action firearm of claim 4 wherein at least one of the cam surfaces has at least three different straight segments each angularly offset from each other.

10. The lever action firearm of claim 1 wherein the bolt carrier assembly defines a transverse bore having a bolt bore diameter and laterally communicating externally to the bolt carrier assembly by way of a slot having a width less than the bolt bore diameter, and the second link includes a transverse pin closely received in the transverse bore and having a reduced thickness in one dimension less than the slot width such that the transverse pin is removable from the transverse bore by way of the slot when the second link is in a selected orientation with respect to the bolt carrier assembly.

11. The lever action firearm of claim 10 wherein the transverse pin has opposed flat surfaces running along its length.

12. The lever action firearm of claim 1 wherein the second link is connected directly to the bolt carrier assembly without additional fasteners.

13. The lever action firearm of claim 1 wherein the connection between the second link and the bolt carrier assembly is free of separate fasteners.

14. The lever action firearm of claim 1 wherein the second link is an articulated member.

15. The lever action firearm of claim 14 wherein the second link has at least two articulations, each articulated in an opposite direction forming a zig-zag shape.

16. The lever action firearm of claim 1 wherein the bolt carrier assembly includes a bolt subassembly and a cam slot, and wherein the second link is pivotally connected to the bolt carrier assembly below the bolt subassembly and rearward of the cam slot.

17. A lever action firearm comprising:

an upper frame defining a bolt passage;

a bolt carrier assembly received in the upper frame and operable to reciprocate between an open position and a closed position;

a lower frame defining a magazine well configured to removably receive a box magazine;

the lower frame removably connected to the upper frame by way of a transverse takedown pin;

an action lever movable between a retracted position and an extended position and having a first pivot, and pivotally connected to the lower frame at the first pivot;

the upper frame including a rear lug received by a recess in the lower frame;

the rear lug and lower frame defining registered pin bores receiving the transverse takedown pin; and wherein the action lever engages with the bolt carrier assembly forward of the rear lug.

18. A lever action firearm comprising:

a frame defining a bolt passage;

a bolt carrier assembly received in the frame and operable to reciprocate between an open position and a closed position;

the frame defining a magazine well configured to removably receive a box magazine;

an action lever movable between a retracted position and an extended position and having a first pivot, and pivotally connected to the frame at the first pivot;

a first link pivotally connected to the frame;

a second link pivotally connected to the bolt carrier assembly;

the first link and second link pivotally interconnected to each other;

the first link defining a cam path;

a cam follower on the action lever operably engaged to the cam path such that movement of the action lever between the retracted position and the extended position generates movement of the bolt carrier assembly between the closed position and the open position;

wherein the cam path includes a first cam surface configured for engagement by the cam follower during movement of the action lever from the retracted position to the extended position, and an opposed second cam surface configured for engagement by the cam follower during movement of the action lever from the extended position to the retracted position; and wherein the first and second cam surfaces define an elongated channel of varying width.

* * * * *